US007900691B2

(12) United States Patent
Kragt et al.

(10) Patent No.: US 7,900,691 B2
(45) Date of Patent: Mar. 8, 2011

(54) HEAT EXCHANGER VESSEL WITH MEANS FOR RECIRCULATING CLEANING PARTICLES

(75) Inventors: Berend-Jan Kragt, Rijswijk (NL); Cornelis Antonie Tjeenk Willink, Rijswijk (NL)

(73) Assignee: Twister B.V., Rijswijk (NL)

( * ) Notice: Subject to any disclaimer, the term of this patent is extended or adjusted under 35 U.S.C. 154(b) by 1078 days.

(21) Appl. No.: 11/658,523

(22) PCT Filed: Jul. 28, 2005

(86) PCT No.: PCT/EP2005/053695

§ 371 (c)(1),
(2), (4) Date: Jan. 25, 2007

(87) PCT Pub. No.: WO2006/010771

PCT Pub. Date: Feb. 2, 2006

(65) Prior Publication Data

US 2008/0302511 A1 Dec. 11, 2008

(30) Foreign Application Priority Data

Jul. 29, 2004 (EP) ..... 04103652

(51) Int. Cl.
*F28G 1/12* (2006.01)
*B08B 9/02* (2006.01)

(52) U.S. Cl. ..... 165/95; 134/7; 134/8

(58) Field of Classification Search ..... 165/95
See application file for complete search history.

(56) References Cited

U.S. PATENT DOCUMENTS

| | | | | | |
|---|---|---|---|---|---|
| 1,795,348 | A | * | 3/1931 | Schmidt | 165/95 |
| 3,882,931 | A | * | 5/1975 | Kumagai | 165/95 |
| 4,208,220 | A | | 6/1980 | White | 134/7 |
| 4,237,962 | A | * | 12/1980 | Vandenhoeck | 165/95 |
| 4,300,625 | A | * | 11/1981 | Mikhailov et al. | 165/95 |
| 4,509,589 | A | * | 4/1985 | Carlson et al. | 165/95 |
| 4,531,570 | A | * | 7/1985 | Dries | 165/95 |
| 5,137,081 | A | * | 8/1992 | Klaren | 165/95 |
| 5,186,815 | A | * | 2/1993 | Lenglet | 208/48 R |
| 5,336,331 | A | * | 8/1994 | Jenkins | 134/22.11 |

(Continued)

FOREIGN PATENT DOCUMENTS

DE 1083058 6/1960

(Continued)

OTHER PUBLICATIONS

International Search Report dated Oct. 18, 2005.

*Primary Examiner* — Allen J Flanigan
(74) *Attorney, Agent, or Firm* — Fliesler Meyer LLP

(57) ABSTRACT

A heat exchanger vessel (1) comprises a tubular outer shell (2) in which a bundle of substantially parallel heat exchanging tubes (7) is arranged between a pair of perforated disk-shaped partitioning walls (5, 6), an inlet (9) and outlet (10) for a first fluid, and at least one inlet (13, 14) and at least one outlet (16) for a second fluid, wherein at least one inlet (14) for the second fluid is provided with particle injection means for injecting cleaning particles into the space between the outer surfaces of the heat exchanger tubes (7) and the inner surface of the tubular shell (2) of the heat exchanger vessel (1) and at least one outlet (16) for the second fluid is connected to means for removing particles from the second fluid and for recirculating particles to at least one inlet (14) of the second fluid.

20 Claims, 1 Drawing Sheet

U.S. PATENT DOCUMENTS

| | | | | |
|---|---|---|---|---|
| 5,676,201 | A | 10/1997 | Klaren | 165/95 |
| 5,706,884 | A | 1/1998 | Klaren | 165/104.16 |
| 6,070,652 | A | 6/2000 | Schildmann et al. | 165/95 |
| 6,073,682 | A | 6/2000 | Klaren | 165/104 |
| 6,109,342 | A | 8/2000 | Klaren | 165/104.16 |
| 6,223,809 | B1 | 5/2001 | Schildmann | 165/95 |
| 2002/0120172 | A1* | 8/2002 | Waycuilis et al. | 585/15 |

FOREIGN PATENT DOCUMENTS

| | | |
|---|---|---|
| EP | 0371859 | 6/1990 |
| FR | 2496861 | 6/1982 |
| JP | 61099100 | 5/1986 |

* cited by examiner

HEAT EXCHANGER VESSEL WITH MEANS FOR RECIRCULATING CLEANING PARTICLES

The present application claims priority on European Patent Application 04103652.6 filed Jul. 29, 2004.

This application is a national stage application which claims the benefit under 35 U.S.C. 371 to Patent Cooperation Treaty Application No. PCT/EP2005/053695, entitled "Heat Exchanger Vessel With Means For Recirculating Cleaning Particles," by inventor Berend-Jan Kragt, filed Jul. 28, 2005, and which has been published as Publication No. WO/2006/010771, which claims priority to European Patent Application No. 04103652.6 filed Jul. 29, 2004.

BACKGROUND OF THE INVENTION

1. Field of the Invention

The invention relates to a heat exchanger (HEX) vessel with means for recirculating cleaning particles.

2. Description of the Related Art

It is suggested in U.S. Pat. Nos. 5,706,884, 5,676,201, 6,073,682 and 6,109,342 to provide a heat exchanger vessel in which a bundle of heat exchanger tubes is provided with means for circulating cleaning particles through the tubes to remove fouling from the inner walls of the tubes.

It is suggested in U.S. Pat. Nos. 6,070,652 and 6,223,809 to recirculate balls through a bundle of heat exchanger tubes to remove any fouling from the inner walls of the tubes.

The known systems are solely designed for cleaning the inner walls of heat exchanger tubes in a heat exchanger vessel.

German patent DE 1083058 suggests a heat exchanger wherein exhaust gases are cooled in the heat exchanger. This heat exchanger includes tubes through which cooling water is circulated and the cleaning particles are added to the flux of exhaust gases such the they remove debris and fouling from the outer surfaces of the cooling tubes. In this vessel the cooling tubes are arranged in a zig-zag pattern within the heat exchanger vessel such that the tubes are, along at least a substantial part of their length, arranged in a substantially transversal orientation relative to the direction of the cleaning particle laden flux of exhaust gases. A disadvantage of the known method is that the cooling tubes are subject to high and uneven wear and are cleaned in an uneven manner. Furthermore, the wall of the heat exchange is exposed to the high pressure and temperature of the exhaust gas, so that the heat exchanger vessel is a thick walled and heavy piece of equipment.

SUMMARY OF THE INVENTION

In accordance with the invention there is provided a heat exchanger vessel, comprising an outer shell in which a bundle of heat exchanging tubes is arranged, which bundle of heat exchanger tubes is coupled to an inlet and an outlet for a first fluid, and the outer shell comprises at least one inlet and at least one outlet for a second fluid, wherein at least one inlet for the second fluid is provided with particle injection means for injecting cleaning particles into the space between the outer surfaces of the heat exchanger tubes and the inner surface of the heat exchanger vessel and the outlet for the second fluid comprises means for removing particles from the second fluid and for recirculating particles to at least one inlet for the second fluid, wherein the heat exchanger tubes are arranged in a substantially tubular mid-section of the vessel and extend substantially parallel to each other between a pair of perforated partitioning walls that are arranged near the ends of said tubular mid-section, the inlet for the section fluid debouches into the interior of the tubular mid-section at a location near one partitioning wall and the outlet for the second fluid debouches into the interior of the tubular mid-section at a location near the other partitioning wall.

The second fluid may be water and the cleaning particles may comprise granules, glass, metal, fibers, plastic and/or chopped wire.

The heat exchanger vessel according to the invention enables, amongst others, direct seawater cooling in high pressure applications, using a heat exchanger vessel which is compact, light-weight and in which fouling and/or scale deposition by the heated flux of seawater is inhibited, such that the heat exchanger does not require frequent maintenance and/or inspection and may be installed subsea.

Preferably, a separator for separating cleaning particles from water is arranged near the outlet for the second fluid, which separator is connected to a cleaning particle recirculation conduit which is connected to at least one fluid inlet for the second fluid and through which in use cleaning particles are recirculated from at least one fluid outlet to at least one fluid inlet for the second fluid.

In such case at least one inlet for the second fluid may be provided with means for pumping water from a body of water into the outer shell of the heat exchanger vessel and at least one outlet for the second fluid may be provided with means for discharging water into said body of water.

The outer shell may comprise a plurality of water inlets, and at least one of these inlets may be connected to a pump via which water from said body of water is pumped into the space between the outer walls of the heat exchanger tubes and at least another one of these inlets is connected to the cleaning particle recirculation conduit.

Optionally, the injection of the cleaning particles in the second fluid is upstream the heat exchanger vessel, near the intake of the second fluid.

Optionally, at least one distribution plate is arranged in the space between the outer surfaces of the heat exchanger tubes and the inner surface of the tubular mid section of the heat exchanger vessel to create an equally distributed flow of the cooling water and fluidized bed of cleaning particles throughout the height of the tubular mid section. The distribution plate may be a perforated plate and/or includes caps, nozzles or devices to preventing backflow of particles. The abrasive particles in combination with the distribution plates continuously remove the film-layer and mix the fluid flow, no baffles are required, minimizing the overall pressure drop and pumping duty.

In accordance with the invention there is also provided a method for recirculating cleaning particles in a heat exchanger vessel comprising an outer shell in which a bundle of heat exchanging tubes is arranged, which bundle of heat exchanger tubes is coupled to an inlet and an outlet for a first fluid, and the outer shell comprises at least one inlet and at least one outlet for a second fluid, wherein a mixture of the second fluid and cleaning particles is injected via least one inlet for the second fluid into the space between the outer surfaces of the heat exchanger tubes and the inner surface of the heat exchanger vessel and each outlet for the second fluid comprises means for removing particles from the second fluid and for recirculating particles to at least one inlet of the second fluid;

wherein the heat exchanger tubes are arranged in a substantially tubular mid-section of the vessel and extend substantially parallel to each other between a pair of perforated disk-shaped partitioning walls that are arranged near the ends of said tubular mid-section, and the mixture of the second fluid and cleaning particles is injected into said space via an inlet that debouches into the interior of the tubular mid-section near one partitioning wall and removed from said space via an outlet which debouches into the interior of the tubular mid-section near the other perforated partitioning wall.

It is preferred that the first fluid which flows through the interior of the heat exchanger tubes is a stream of natural gas and the second fluid, which flows through the space between the outer surfaces of the heat exchanger tubes and the inner surface of the tubular mid-section of the heat exchanger vessel is water.

It is also preferred that the static pressure of the stream of natural gas, which flows through the interior of the heat exchanger tubes, is higher than the static pressure of the stream of water and cleaning particles that flows through the space between the outer surfaces of the heat exchanger tubes and the inner surface of the tubular mid-section of the heat exchanger vessel.

These and further features, embodiments and advantages of the heat exchanger vessel according to the present invention will become apparent from the accompanying claims, abstract and the following detailed description in which reference is made to the accompanying drawings.

BRIEF DESCRIPTION OF THE DRAWINGS

A preferred embodiment of the heat exchanger vessel according to the invention will be described in more detail and by way of example with reference to the accompanying drawings, in which.

DESCRIPTION OF A PREFERRED EMBODIMENT OF THE INVENTION

Figure 1:
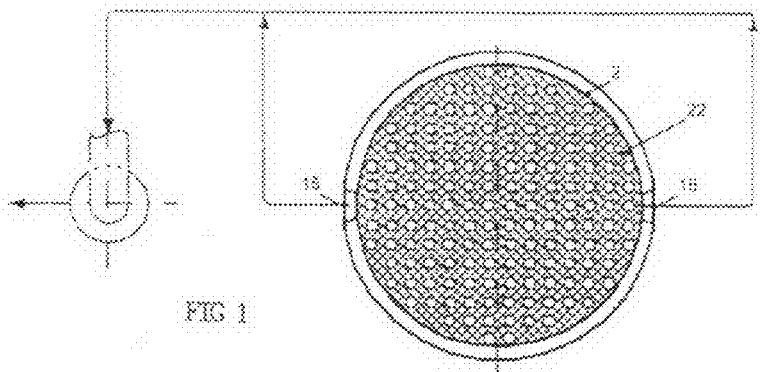
FIG. 1 is a schematic longitudinal sectional view of the self-cleaning heat exchanger vessel according to the invention.
Figure 2:
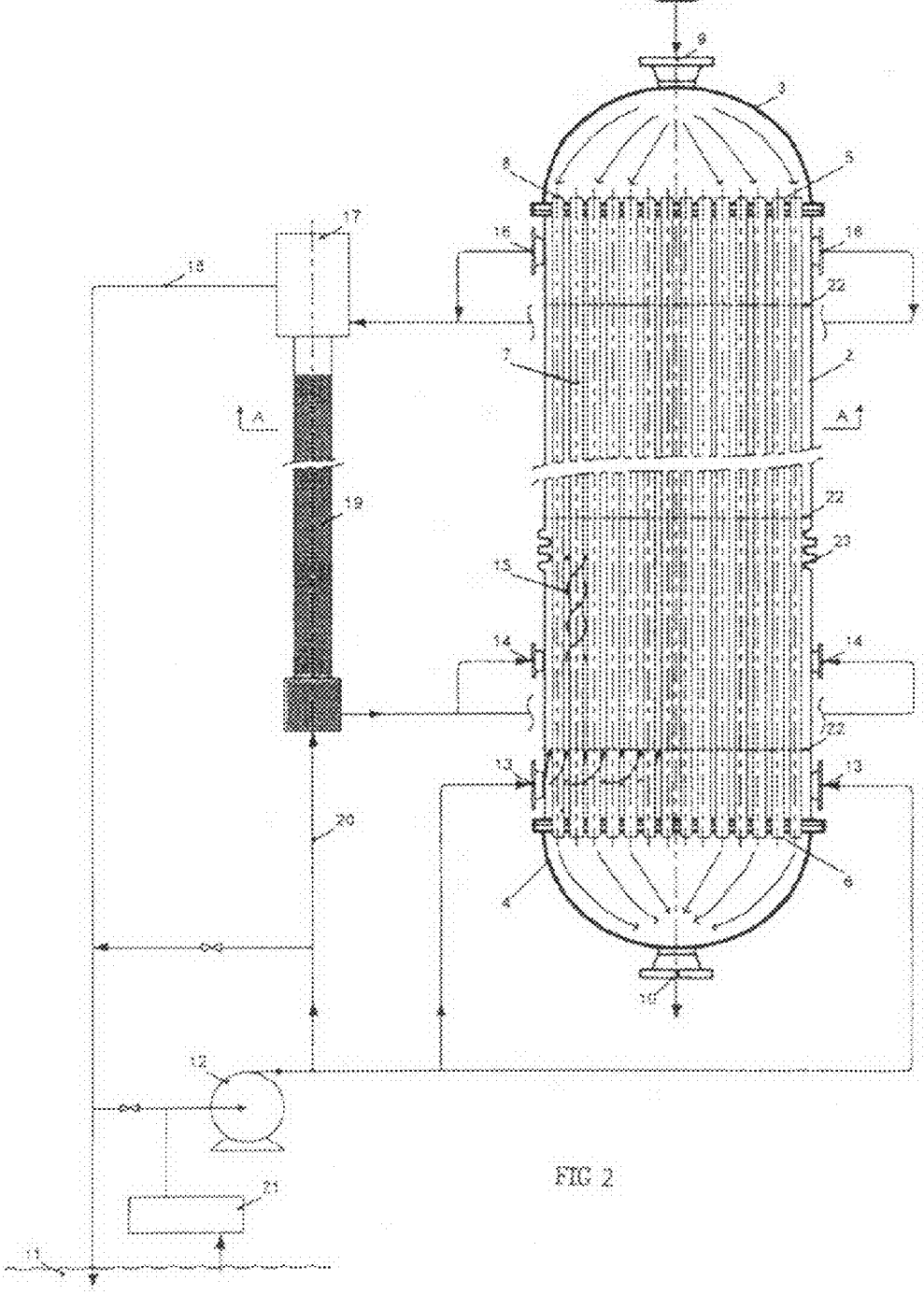
FIG. 2 is a cross-sectional view of the vessel of FIG. 1 taken along line A-A and seen in the direction of the arrows.

FIG. 1 shows a heat exchanger vessel 1 which has a tubular mid section 2 and dome-shaped top and bottom sections 3 and 4, known as headers, which are separated from each other by disc-shaped partitioning walls 5 and 6.

The tubular mid section 2 comprises a bundle of heat exchanger tubes 7 which extend through openings 8 in the disc-shaped partitioning walls 5 and 6 such that the interior of the heat exchanger tubes 7 is connected in fluid communication for the first fluid with the interior of the dome-shaped top and bottom sections 3 and 4.

An inlet 9 for a first fluid, which may be a high pressure and high temperature natural gas or other low or high pressure fluid, is arranged at the top of the dome-shaped top section 3. An outlet 10 for the first fluid is arranged at the bottom of the dome-shaped bottom section 4 of the vessel 1. In use the first fluid flows via the inlet 9 into the interior of the top section 3 of the vessel 1 and flows via the interior of the bundle of heat exchanger tubes 7 into the interior of the bottom section 4 of the vessel 1 and is then discharged via the outlet 10.

A second fluid, which is in the example shown water, is pumped from a body of water 11, such as a river, lake, sea, ocean or an underground aquifer, and used as a coolant for cooling the first fluid. The cooling water is pumped by a pump 12, possibly pre-treated using filters 21 and/or chemical injection, via a pair of lower inlets 13 into the interior of the tubular mid section 2 which surrounds the heat exchanger pipes 7.

To inhibit offset of fouling on the interior of the tubular mid section 2 in the region between the heat exchanger tubes 7 a mixture of water and cleaning particles is injected into the interior of the tubular mid section 2 via a pair of intermediate inlets 14. This mixture is mixed up with the water injected via the lower inlets 13 and induced to flow up through the interior of the tubular mid section 2, such that the cleaning particles flow along the heat exchanger tubes 7 and thereby continuously remove any offset of scaling and/or other fouling from the outer surfaces of the tubes 7 as well as from the inner surface of the tubular wall of the tubular mid section 2. A series of flow and particle distribution plates 22 is arranged at different levels in the interior, including one between inlet of the second fluid 13 and the intermediate inlets 14 of the tubular mid section 2 to create an equally distributed flow of the cooling water and fluidized bed of cleaning particles throughout the height of the tubular mid section 2. The distribution plates, also providing firmness to the vessel 1 and the tubes 7, could be perforated plates or include caps, nozzles or devices to preventing backflow of the particles. Since the abrasive particles in combination with the distribution plates continuously remove the film-layer and mix the fluid flow, no baffles are required, minimizing the overall pressure drop and pumping duty.

The mixture of water and cleaning particles is discharged from the interior of the tubular mid section 2 via a pair of upper outlets 16 and directed into a water/cleaning particle separator 17 in which a stream of hot water 18 is separated from a cleaning particles stream 19. The hot water stream 18 is discharged into the body of water 11 and the cleaning particles stream 19 is mixed with a cold water stream 20 and pumped back into the interior of the tubular mid section 2 of the heat exchanger vessel 1 via the intermediate inlets 14.

Depending on the local environmental regulations the hot water stream 18 is commingled with a fraction of the cold water flow before being discharged into the body of water 11. Turndown is managed by either reducing the second fluid flow and/or by commingling the cold second fluid flow with a fraction of the hot fluid flow 18.

The cleaning action of the cleaning particles permits heating up of the water in the tubular mid section 2 of the vessel 1 to a much higher temperature than in conventional heat exchanger vessels. In conventional heat exchanger vessels, known as direct and indirect seawater HEX assemblies, which are generally used in ships, power plants and offshore platforms, the skin temperature of the cooling water at the wall of the heat exchanger tubes should remain lower than about 50-55 degrees Celsius to avoid scaling and other fouling of the heat exchanger tubes and the inner wall of the vessel. In the vessel 1 according to the invention the skin temperature of the water flowing along the outer surfaces of the heat exchanger tubes 7 may well exceed 80 degrees Celsius, because any scale precipitation will be abraded away by the cleaning particles. The increase of the permitted water temperature leads to a significant reduction of the size of the tubular mid section 2, of the corresponding length and weight of the heat exchanger tubes 7, of the flux and velocity of the cooling water and of the required power of the water circulation pump 12. The inhibition of offset of fouling significantly reduces the maintenance required and increases the availability of the plant.

High pressure gas only flows into the dome-shaped upper and lower parts 3 and 4 of the vessel 1 and into the interior of the heat exchanger tubes 7. Therefore only the heat exchanger tubes 7 and the dome-shaped upper and lower parts 3 and 4 of the heat exchanger vessel 1 need to have a high wall thickness and to be made of high strength steel, titanium or other alloys.

The tubular mid section 2 of the heat exchanger is filled with low pressure water and can have a relatively low wall thickness. The use of a heat exchanger vessel 1 with a smaller tubular mid section 2 than conventional heat exchanger vessels and the use of a tubular mid section 2 with a relatively low wall thickness creates a heat exchanger vessel 1 which is significantly smaller and lighter than conventional heat exchanger vessels.

It will be understood that the heat exchanger vessel according to the invention may have the first fluid flow from the bottom to the top, co-current with the second fluid.

It will be understood that the heat exchanger vessel according to the invention may have a square shape, as also known in aircooler banks, instead of a round shape and that the top and bottom sections 3 and 4 may be box-shaped instead of dome-shaped as shown in the drawings.

Optionally, the heat exchanger vessel according to the invention may comprise a bellow 23 to inhibit e.g. thermal expansion and/or compression stresses, if that turns out to be required for mechanical reason.

It will be understood that the invention may have the injection of the cleaning particles in the second fluid upstream the heat exchanger vessel, near the intake of the second fluid from the second fluid supply body 11.

Furthermore, the amount of water inlets and outlets 13, 14, 16 may be increased to further equalize the upward water flux and the fluidized bed of cleaning particles in the interior of the vessel 2.

We claim:

1. A heat exchanger vessel comprising:

an outer shell, the outer shell comprising at least one inlet and at least one outlet for a second fluid;

a bundle of heat exchanger tubes arranged in the outer shell wherein the heat exchanger tubes are arranged in a substantially tubular mid-section of the vessel and extend substantially parallel to each other between a pair of perforated partitioning walls that are arranged near the ends of the tubular mid-section;

an inlet for a first fluid to which the bundle of heat exchanger tubes is coupled;

an outlet for the first fluid to which the bundle of heat exchanger tubes is coupled;

at least one inlet for a second fluid connected to the outer shell wherein the at least one inlet for the second fluid debouches into the interior of the tubular mid-section at a location near one partitioning wall and wherein the at least one inlet for the second fluid is provided with a particle injector adapted to inject cleaning particles into the second fluid, the particles effective to clean the space between the outer surfaces of the heat exchanger tubes and the inner surface of the heat exchanger vessel;

at least one outlet for a second fluid connected to the outer shell wherein the outlet for the section fluid debouches into the interior of the tubular mid-section at a location near the other partitioning wall and wherein the at least one outlet for the second fluid is provided with a particle separator effective to remove particles from the second fluid; and a series of distribution plates that are arranged in the space between the outer surfaces of the heat exchanger tubes and the inner surface of the tubular mid-section of the heat exchanger vessel to create an equally distributed flow of the cooling water and fluidized bed of cleaning particles throughout the height of the tubular mid section, wherein the at least one inlet for the second fluid comprises a lower inlet and an intermediate inlet, and wherein the series of distribution plates are arranged at different levels in the interior, including one distribution plate between the lower inlet and the intermediate inlet.

2. The heat exchanger vessel of claim 1, wherein the second fluid is water and the cleaning particles comprise particles selected from the group consisting of granules, glass, metal, fibers, plastic, chopped wire and mixtures thereof.

3. The heat exchanger vessel of claim 2, wherein the separator for separating cleaning particles from water is arranged near the outlet for the second fluid, which separator is connected to a cleaning particle recirculation conduit which is connected to at least one fluid inlet for the second fluid and through which in use cleaning particles are recirculated from at least one fluid outlet to at least one fluid inlet for the second fluid.

4. The heat exchanger of claim 3, wherein at least one inlet for the second fluid is provided with means for pumping water from a body of water into the outer shell of the heat exchanger vessel and wherein at least one outlet for the second fluid is provided with means for discharging water into said body of water.

5. The heat exchanger of claim 1, wherein the injector of the second fluid inlet is upstream the heat exchanger vessel, near the intake of the second fluid.

6. The heat exchanger of claim 1, wherein each said distribution plate is a perforated plate and/or includes caps, nozzles or devices to preventing backflow of particles.

7. The heat exchanger of claim 1, wherein the heat exchanger is configured such that when in operation, the cleaning particles in combination with the distribution plates continuously remove a static fluid film layer surrounding the outer surfaces of the heat exchanger tubes and mix the flow of the second fluid in the tubular mid section of the vessel, thereby enhancing the heat exchange between the first and second fluid.

8. The heat exchanger of claim 1, wherein the heat exchanger is located subsea.

9. A method of recirculating cleaning particles in a heat exchanger vessel, the method comprising the steps of:

providing a heat exchanger with an outlet shell within which a bundle of heat exchanger tubes is arranged, the tubes being arranged in a substantially tubular mid-section of the heat exchanger vessel, and the tubes being substantially parallel to each other and between a pair of perforated disk-shaped partitioning walls that are arranged near the ends of the tubular mid-section;

providing the outer shell with at least one inlet, the at least one inlet being near a first partitioning wall;

providing the outer shell with at least one outlet, the at least one outlet being near a second partitioning wall;

providing a series of distribution plates that are arranged in the space between the outer surfaces of the heat exchanger tubes and the inner surface of the tubular mid-section of the heat exchanger vessel to create an equally distributed flow of the cooling water and fluidized bed of cleaning particles throughout the height of the tubular mid section, wherein the at least one inlet for the second fluid comprises a lower inlet and an intermediate inlet, and wherein the series of distribution plates are arranged at different levels in the interior, including one distribution plate between the lower inlet and the intermediate inlet;

providing a first fluid through the heat exchanger tubes;

providing a second fluid into the at least one inlet of the outer shell, the second fluid leaving the heat exchanger vessel through the at least one outlet of the shell;

injecting cleaning particles into the second fluid entering the outer shell, the particles effective to clean the space between the outer surfaces of the heat exchanger tubes and the inner surface of the heat exchanger vessel; and recovering from second fluid exiting the outer shell at least a portion of the cleaning particles.

10. The method of claim 9 further comprising the step of recycling at least a portion of the cleaning particles recovered from the second fluid exiting the outer shell to the inlet to the outer shell.

11. The method of claim 9 wherein the first fluid is natural gas and the second fluid is water.

12. The method of claim 9 wherein the water is sea water.

13. The method of claim 9 wherein the static pressure of the natural gas in the heat exchanger vessel is higher than the static pressure of the water in the mid-section of the heat exchanger vessel.

14. The method of claim 9 wherein the cleaning particles comprise grandules.

15. The method of claim 9 wherein the cleaning particles comprise glass.

16. The method of claim 9 wherein the cleaning particles comprise metal.

17. The method of claim 9 wherein the cleaning particles comprise fibers.

18. The method of claim 9 wherein the cleaning particles comprise plastic.

19. The method of claim 9 wherein the cleaning particles comprise chopped wire.

20. A heat exchanger vessel comprising:

an outer shell, the outer shell comprising at least one inlet and at least one outlet for a second fluid;

a bundle of heat exchanger tubes arranged in the outer shell wherein the heat exchanger tubes are arranged in a substantially tubular mid-section of the vessel and extend substantially parallel to each other between a pair of perforated partitioning walls that are arranged near the ends of the tubular mid-section;

an inlet for a first fluid to which the bundle of heat exchanger tubes is coupled;

an outlet for the first fluid to which the bundle of heat exchanger tubes is coupled;

at least one inlet for a second fluid connected to the outer shell wherein the at least one inlet for the second fluid debouches into the interior of the tubular mid-section at a location near one partitioning wall and wherein the at least one inlet for the second fluid is provided with a particle injector adapted to inject cleaning particles into the second fluid, the particles effective to clean the space between the outer surfaces of the heat exchanger tubes and the inner surface of the heat exchanger vessel, wherein the at least one inlet for the second fluid is provided with means for pumping the second fluid from a body of the second fluid into the outer shell of the heat exchanger vessel and wherein at least one outlet for the second fluid is provided with means for discharging the second fluid into said body of the second fluid;

at least one outlet for a second fluid connected to the outer shell wherein the outlet for the section fluid debouches into the interior of the tubular mid-section at a location near the other partitioning wall and wherein the at least one outlet for the second fluid is provided with a particle separator effective to remove particles from the second fluid, wherein the separator for separating cleaning particles from the second fluid is arranged near the outlet for the second fluid, which separator is connected to a cleaning particle recirculation conduit which is connected to at least one fluid inlet for the second fluid and through which in use cleaning particles are recirculated from at least one fluid outlet to at least one fluid inlet for the second fluid, wherein the outer shell comprises a plurality of inlets for the second fluid, and at least one of these inlets is connected to a pump via which the second fluid from said body of the second fluid is pumped into the space between the outer walls of the heat exchanger tubes and at least another one of these inlets is connected to the cleaning particle recirculation conduit.

* * * * *